US008789930B2

(12) United States Patent
Zhang

(10) Patent No.: US 8,789,930 B2
(45) Date of Patent: Jul. 29, 2014

(54) LIQUID EJECTING APPARATUS AND METHOD FOR CONTROLLING THEREOF

(71) Applicant: Seiko Epson Corporation, Tokyo (JP)

(72) Inventor: Junhua Zhang, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/761,619

(22) Filed: Feb. 7, 2013

(65) Prior Publication Data

US 2013/0208034 A1 Aug. 15, 2013

(30) Foreign Application Priority Data

Feb. 9, 2012 (JP) ..... 2012-026750

(51) Int. Cl.
*B41J 2/045* (2006.01)
*B41J 2/04* (2006.01)

(52) U.S. Cl.
USPC ..... 347/68; 347/54

(58) Field of Classification Search
USPC ..... 347/5, 6, 9, 20, 54, 68, 70
See application file for complete search history.

(56) References Cited

U.S. PATENT DOCUMENTS

| | | | | |
|---|---|---|---|---|
| 5,988,799 | A * | 11/1999 | Abe et al. | 347/68 |
| 6,223,405 | B1 * | 5/2001 | Oikawa et al. | 347/68 |
| 6,332,671 | B1 * | 12/2001 | Takahashi et al. | 347/68 |
| 6,394,589 | B1 * | 5/2002 | Willus et al. | 347/68 |
| 2002/0180827 | A1 | 12/2002 | Hirota | |
| 2008/0055378 | A1 | 3/2008 | Drury et al. | |

FOREIGN PATENT DOCUMENTS

| | | |
|---|---|---|
| JP | 2002-355961 | 12/2002 |
| JP | 2008-513245 | 5/2008 |

* cited by examiner

*Primary Examiner* — Kristal Feggins
(74) *Attorney, Agent, or Firm* — Harness, Dickey & Pierce, P.L.C.

(57) ABSTRACT

A liquid ejecting apparatus includes: a liquid ejecting head having a pressure generation chamber in which a liquid is charged, a pressure generation unit which generates pressure change in the liquid inside the pressure generation chamber with supply of a driving signal, and a nozzle opening which ejects the liquid inside the pressure generation chamber according to the pressure change; and a control unit which has an expansion element expanding the pressure generation chamber and a contraction element contracting the pressure generation chamber, and supplies a micro-vibration driving signal to a piezoelectric element so as to generate the micro-vibration of the liquid to the inside of the pressure generation chamber without ejecting the liquid from the nozzle opening, wherein the micro-vibration driving signal is formed so that the inclination of the expansion element is greater than the inclination of the contraction element.

5 Claims, 7 Drawing Sheets

LIQUID EJECTING APPARATUS AND METHOD FOR CONTROLLING THEREOF

BACKGROUND

1. Technical Field

The present invention relates to a liquid ejecting apparatus and a method for controlling thereof, and in particular, is useful to apply when vibrating a liquid inside a pressure generation chamber in the vicinity of a nozzle opening using a micro-vibration driving signal so as to agitate the liquid.

2. Related Art

As a liquid ejecting apparatus, for example, there is an ink jet type recording apparatus having an ink jet type recording head including a plurality of pressure generation chambers which generate pressure to eject ink droplets using a pressure generation unit formed of a piezoelectric element, an ink supply path which supplies ink from a common manifold to each of the pressure generation chambers separately and a nozzle opening which is formed in each of the pressure generation chambers and ejects the ink droplets (for example, see JP-A-2002-355961).

In the ink jet type recording apparatus described above, the ink droplets are ejected from the nozzle opening to the outside and lands on a predetermined position of a medium such as paper by applying ejecting energy to the ink inside the pressure generation chamber communicating with the nozzle opening corresponding to a printing signal.

Accordingly, in the ink jet type recording apparatus of this type, the nozzle opening faces the atmosphere. Therefore, the ink is thickened by evaporation of moisture via the nozzle opening. As a result, the ejection characteristics of the ink droplets may be adversely affected due to the thickened ink. In other words, even when just a portion of the thickened ink exists, drawbacks occur in which an ejection amount and an ejection speed of the ink droplets via the nozzle opening are changed, and variation in the landing occurs.

Therefore, in the general ink jet type recording apparatus according to the related art, it has been devised to suppress the thickening of the ink droplets by 1) always keeping the ink in the vicinity of the nozzle opening in a fresh state by moving the ink jet type recording head to other portion rather than just the media and by discharging the ink out appropriately before the ink is thickened, or 2) when the ink droplets are not ejected, micro-vibrations are generated in the pressure generation chamber by a PZT or the like that is a pressure generation unit and the ink inside the pressure generation chamber is agitated.

However, there are problems in that 1) the ink is ineffectively discarded in the method in which the ink jet type recording head is moved to a portion other than the media and the ink is discharged out appropriately before the ink is thickened, and 2) it is unclear whether or not the micro-vibration is appropriate enough to prevent the thickening of the ink even though the ink is vibrated, because the inclination of an expansion element (an element in which the ink is drawn by increasing the volume inside the pressure generation chamber; the same as below) and the inclination of a contraction element (an element in which the ink is ejected by the volume being decreased inside the pressure generation chamber; the same as below) in the micro-vibration driving signal are usually the same as each other, in the method in which the micro-vibration is generated in the pressure generation chamber and the ink inside the pressure generation chamber is agitated so that the thickening of the ink is suppressed.

In addition, the same problems are present in a liquid ejecting head, ejecting other liquids, as well as the ink jet type recording head ejecting ink.

SUMMARY

An advantage of some aspects of the invention is to provide a liquid ejecting apparatus and a method for controlling thereof in which a favorable thickening suppression effect can be obtained by realizing optimization of requirements for generating a micro-vibration such as a waveform of a micro-vibration driving signal which generates a micro-vibration.

A configuration of the invention for obtaining the object described above is based on knowledge obtained from a result of review of a waveform of a micro-vibration driving signal, a shape of the nozzle opening or the like so that optimization of thickening suppression can be improved with the micro-vibration. In addition, a micro-vibration mode is a driving mode of the recording head, which is carried out for the object to prevent the thickening of the ink by supplying a driving signal including an expansion element which expands a pressure generation chamber and a contraction element which contracts the pressure generation chamber to a pressure generation unit and by generating the micro-vibration to the ink inside the pressure generation chamber without ejecting the ink from a nozzle opening and then agitating the ink in the vicinity of the nozzle opening.

FIGS. 5 and 6 are waveform views illustrating the micro-vibration driving signal used in a simulation of an agitating situation of the ink with the micro-vibration. A driving signal $S_{22}$ illustrated in FIG. 5 is a one-shot pulse in which a contraction element $E_{23}$, a holding element $E_{22}$ and an expansion element $E_{21}$ are formed continuously. Here, the inclination of the contraction element $E_{23}$ is formed to five times the inclination of the expansion element $E_{21}$. In particular, the contraction element $E_{23}$, the holding element $E_{22}$ and the expansion element $E_{21}$ are 2 μs, 1 μs and 10 μs, respectively. In addition, the difference between the maximum potential and the minimum potential is 16 V. In the driving signal $S_{22}$, the push is stronger than the pull.

On the other hand, the driving signal $S_{23}$ illustrated in FIG. 6 is a one-shot pulse in which an expansion element $E_{31}$, a holding element $E_{32}$ and a contraction element $E_{33}$ are formed continuously. Here, the inclination of the expansion element $E_{31}$ is formed to five times the inclination of the contraction element $E_{33}$. In particular, the extension element $E_{31}$, the holding element $E_{32}$ and the contraction element $E_{33}$ are 2 μs, 1 μs and 10 μs, respectively. In addition, the difference between the maximum potential and the minimum potential is 16 V. In the driving signal $S_{23}$, the pull is stronger than the push.

FIGS. 7A to 7C illustrate the simulation results when the micro-vibration is generated with the driving signal $S_{22}$ respectively and FIGS. 8A to 8C illustrate the simulation results when the micro-vibration is generated with the driving signal $S_{23}$, respectively. In addition, the drawings illustrate shapes of different times in the order of A, B and C in the time series. In addition, the viscosity of the ink is thickened in the order of blue, light blue, green and red in the drawings annexed to the specification (hereinafter, the same as in FIGS. 9 to 12 illustrating the simulation results).

As illustrated in FIGS. 7A to 7C, when the driving signal $S_{22}$ is used, a thickened portion of the front end illustrated in a red portion in the drawings is protruded from a nozzle opening 13A as illustrated in FIG. 7A in the contraction element $E_{23}$, the front end is broken off by drawing from the nozzle opening 13A into the inside thereof as illustrated in FIG. 7B in the expansion element $E_{21}$, and the front end is ejected from the nozzle opening 13A as illustrated in FIG. 7C. Here, the object of the micro-vibration cannot be obtained.

On the other hand, when the driving signal $S_{23}$ is used, the thickened portion of the front end illustrated in a red portion in FIGS. 8A to 8C is drawn once as illustrated in FIG. 8A in the expansion element $E_{31}$, is pushed out from the nozzle opening 13A as illustrated in FIG. 8B in the contraction element $E_{33}$ and is drawn inside the nozzle opening 13A again in FIG. 8C. Accordingly, in this case, the agitating of the thickened portion can be favorably carried out.

FIG. 9 illustrates a simulation result when the micro-vibration is generated with the driving signal $S_{22}$ having the same waveform as in FIGS. 7A to 7C and FIG. 10 illustrates a simulation result when the micro-vibration is generated with the driving signal $S_{23}$ having the same waveform as in FIGS. 8A to 8C. The micro-vibration is generated using a signal of 50 Hz in FIGS. 9 and 10 while the micro-vibration is generated using the driving signals $S_{22}$ and $S_{23}$ of the one-shot pulse in the simulations illustrated in FIGS. 7A to 8C. In addition, the difference between the maximum potential and the minimum potential is 12 V, and states after 1 ms are illustrated.

It can be seen that the ink having high viscosity remains in the front end of the nozzle opening 13A as referring to FIG. 9, while favorable agitating is carried out when drawn into the pressure generation chamber side of the nozzle opening 13A as referring to FIG. 10.

It can be seen that it is preferable that the pull be strong and the push be weak in the micro-vibration mode.

FIGS. 11A to 12B are drawings simulating the difference of the agitating effect by the shapes of the nozzle openings and the time that has elapsed in the order of A and B in all the drawings. FIGS. 11A and 11B illustrate a case where the shape of a nozzle opening 13B is a two-step nozzle shape. FIGS. 12A and 12B illustrate a case where the shape of the nozzle opening 13A is a tapered nozzle shape the diameter of which is gradually decreased to the front end of the opening. Comparing FIGS. 11A and 11B, and FIGS. 12A and 12B, it can be seen that the ink having a high viscosity is deeply diffused and favorable agitating effect can be obtained in the case of FIGS. 12A and 12B. As a result, it is preferable that the nozzle opening be the tapered shape in the agitating effect by the micro-vibration.

Based on the knowledge described above, an aspect of the invention is a liquid ejecting apparatus including: a liquid ejecting head having a pressure generation chamber in which a liquid is charged, a pressure generation unit which generates pressure change in the liquid inside the pressure generation chamber with supply of a driving signal and a nozzle opening which ejects the liquid inside the pressure generation chamber according to the pressure change; and a control unit which has an expansion element expanding the pressure generation chamber and a contraction element contracting the pressure generation chamber, and supplies a micro-vibration driving signal to the pressure generation unit so as to generate the micro-vibration of the liquid to the inside of the pressure generation chamber without ejecting the liquid from the nozzle opening, wherein the micro-vibration driving signal is formed so that inclination of the expansion element is greater than inclination of the contraction element.

According to the aspect, since the pull of the liquid in the expansion element is more rapidly carried out than the push in the contraction element, the liquid portion which has a high viscosity can be drawn into the pressure generation chamber side opposite to the nozzle opening by the micro-vibration as illustrated in FIGS. 8A to 8C, and the ejection characteristics of the liquid can be favorably kept via the nozzle opening.

Here, it is preferable that the relationship between the inclination of the expansion element and the inclination of the contraction element in the micro-vibration driving signal be (the inclination of the expansion element)≥2×(the inclination of the contraction element). In this case, the liquid thickened can be reliably drawn into the pressure generation chamber side according to the agitating of the liquid by the micro-vibration.

It is preferable that the liquid ejecting head have a circulation path in which the liquid charged in the pressure generation chamber is circulated. In this case, the liquid in the vicinity of the nozzle opening is always replaced according to the circulation of the liquid and the agitating effect of the liquid by the micro-vibration is synergized and then the increase in the viscosity of the liquid inside the pressure generation chamber in the vicinity of the nozzle opening can be effectively suppressed.

In addition, it is preferable that the nozzle opening of the liquid ejecting head be formed as a tapered shape such that the diameter thereof is gradually decreased towards the opening thereof. As illustrated in FIGS. 12A and 12B, the agitating effect of the liquid by the micro-vibration can be optimized in terms of the shape of the nozzle opening.

Another aspect of the invention is a method for controlling a liquid ejecting apparatus having: a liquid ejecting head having a pressure generation chamber in which a liquid is charged, a pressure generation unit which generates pressure change in the liquid inside the pressure generation chamber with supply of a driving signal and a nozzle opening which ejects the liquid inside the pressure generation chamber according to the pressure change, the method including: controlling the liquid inside the pressure generation chamber to generate micro-vibrations with a micro-vibration driving signal without ejecting the liquid from the nozzle opening so that inclination of an expansion element expanding the pressure generation chamber is greater than inclination of a contraction element contracting the pressure generation chamber.

According to the aspect, since the draw of the liquid in the expansion element is rapidly carried out more than the push in the contraction element, the liquid portion which has a high viscosity can be drawn into the inside of the pressure generation chamber as illustrated in FIGS. 8A to 8C, and the ejection characteristics of the liquid can be favorably kept via the nozzle opening.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described based on the drawings.

Figure 1:
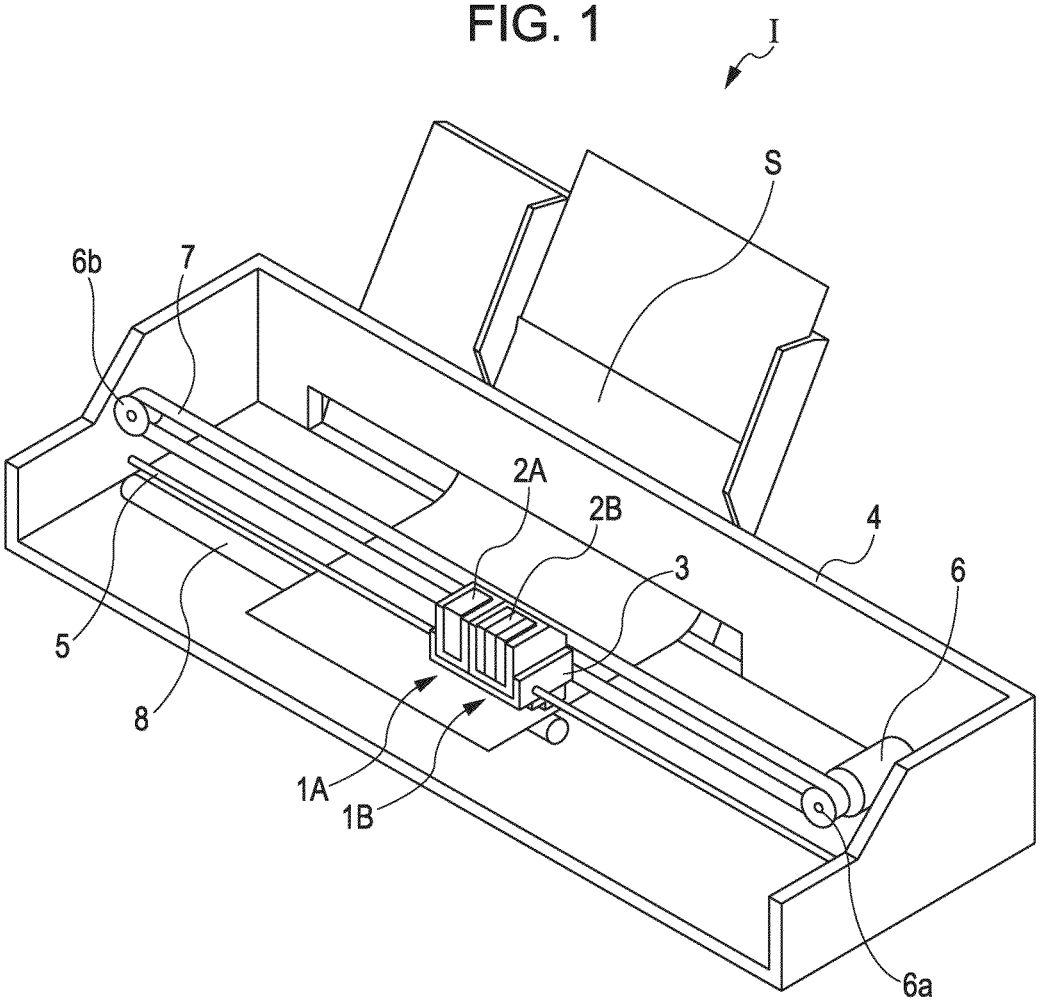
FIG. 1 is a schematic perspective view of an ink jet type recording apparatus according to an embodiment of the invention.

FIG. 1 is a schematic perspective view of an ink jet type recording apparatus that is an example of a liquid ejecting apparatus according to one embodiment of the invention. As illustrated in the drawing, an ink jet type recording apparatus I according to the embodiment has ink jet type recording heads (below, also simply referred to as a recording head) 1A and 1B described in detail below, and ink cartridges 2A and 2B configuring a supply unit which supplies the ink to the recording heads 1A and 1B are detachably provided in the ink jet type recording apparatus I. A carriage 3 having the recording heads 1A and 1B is provided in a carriage shaft 5 mounted on an apparatus body 4 so as to be movable in the axial direction. The recording heads 1A and 1B eject a black ink composition and a color ink composition respectively.

In addition, in the vicinity of one end portion of the carriage shaft 5, a driving motor 6 is provided. In the front end portion of a shaft of the driving motor 6, a first pulley 6*a* having a groove at the outer periphery thereof is provided. Furthermore, in the vicinity of the other end portion of the carriage shaft 5, a second pulley 6*b* corresponding to the first pulley 6*a* of the driving motor 6 is rotatably provided. A timing belt 7 formed of an elastic member such as a rubber in a circular shape is hung over between the first pulley 6*a* and the second pulley 6*b*.

Then, the driving force of the driving motor 6 is transmitted to the carriage 3 via the timing belt 7 so that the carriage 3 mounted on the recording heads 1A and 1B is moved along the carriage shaft 5. Meanwhile, a platen 8 is provided along the carriage 3 in the apparatus body 4. The platen 8 can be rotated by the driving force of a paper feeding motor (not illustrated) and a recording sheet S that is a recording medium such as a paper fed by a paper feeding roller or the like is wound around the platen 8 so as to be transported.

Figure 2:
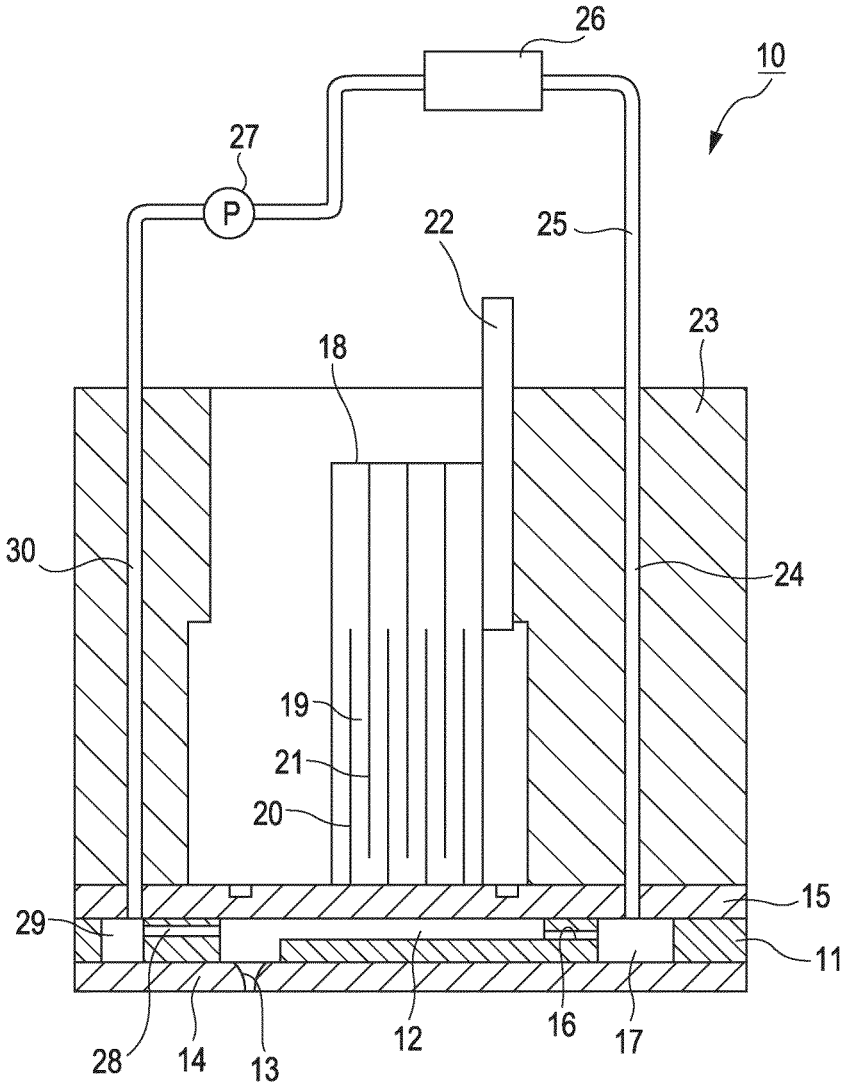
FIG. 2 is a cross-sectional view illustrating a recording head in the embodiment of the invention.

Here, the ink jet type recording head mounted on the above described ink jet type recording apparatus I will be described. FIG. 2 is a cross-sectional view illustrating an example of the ink jet type recording head in the embodiment of the invention.

An ink jet type recording head 10 illustrated in FIG. 2 is a type having a longitudinal vibration type piezoelectric element. A plurality of pressure generation chambers 12 are arranged in a flow path substrate 11 and both sides in the thickness direction (the up and down direction in the drawing) of the flow path substrate 11 are sealed by a nozzle plate 14 having a nozzle opening 13 corresponding to each of the pressure generation chambers 12 and a vibration plate 15. Here, the nozzle opening 13 is formed in a tapered shape such that the diameter is gradually reduced to the opening.

In addition, the flow path substrate 11 has a manifold 17 which communicates with each of the pressure generation chambers 12 via an ink supply port 16 respectively and is a common ink chamber of a plurality of pressure generation chambers 12. The manifold 17 faces an opening section of one side (a lower end side in the drawing) of an ink supply path 24 which passes through a case head 23 and a vibration plate 15 and introduces the ink. An opening section of the other side (an upper end side in the drawing) of the ink supply path 24 communicates with an ink cartridge 26 in which the ink is stored via a flow path 25.

Meanwhile, on the opposite side of the pressure generation chamber 12 with respect to the vibration plate 15, the front end of each of piezoelectric elements 18 abuts a region corresponding to each of the pressure generation chambers 12 respectively. The piezoelectric elements 18 are configured in the manner that a piezoelectric material 19, electrode forming materials 20 and 21 are alternately inserted in a pinched manner to be laminated, and an inactive region which does not contribute to the vibration is fixed to the case head 23 via a fixed substrate 22. In addition, the fixed substrate 22, the vibration plate 15, the flow path substrate 11 and the nozzle plate 14 are integrally fixed to each other via the case head 23.

In the ink jet type recording head 10 having the configuration described above, the ink is supplied to the manifold 17 via the flow path 25 and the ink supply path 24 communicating with the ink cartridge 26, and is distributed to each of the pressure generation chambers 12 via the ink supply port 16. In this state, the piezoelectric element 18 is contracted by applying a voltage to the piezoelectric element 18. Accordingly, the vibration plate 15 is deformed with the piezoelectric element 18 (pulled upwards in the drawing) so that the volume of the pressure generation chamber 12 is widened and the ink is drawn into the pressure generation chamber 12. Then, the piezoelectric element 18 is extended to return to the original state when the voltage is removed which is applied to the electrode forming materials 20 and 21 of the piezoelectric element 18, based on the driving signal for ejecting which is transmitted from a driving signal generation section 113 (see FIG. 3) of a control section 110 (see FIG. 3) after the ink fills the inside of the pressure generation chamber 12 to the nozzle opening 13. Accordingly, since the vibration plate 15 is also deformed to return to the original state, the pressure generation chamber 12 is contracted and an inner pressure thereof is increased and the ink droplets are ejected from the nozzle opening 13. In other words, in the embodiment, the longitudinal type piezoelectric element 18 is provided as the pressure generation unit which generates a pressure change in the pressure generation chamber 12.

Further, the embodiment employs a forced circulation system which circulates the ink using a pump 27 that is an outside driving source. The circulation of the ink in this case is carried out on a path in which the ink leads from the ink cartridge 26 to the inside of the manifold 17 via the flow path 25 and the ink supply path 24, and returns to the ink cartridge 26 via the ink supply port 16, the pressure generation chamber 12, a circulation flow path 28, a manifold 29 that is a type of another liquid storage section, an ink supply path 30, the flow path 25 and the pump 27. Here, the circulation flow path 28 is formed in parallel with the nozzle opening 13 towards the nozzle opening side rather than the pressure generation chamber 12 so as to divert a portion of the ink discharged from the pressure generation chamber 12. Thus, the pressure generation chamber 12 and the manifold 29 communicate with each other. In addition, the manifold 29 faces the opening section of one side (the lower end side in the drawing) of the ink supply path 30 which circulates the ink passing through the vibration plate 15 and the case head 23 and drawn by the pump 27. The opening section of the other side (the upper end side in the drawing) of the ink supply path communicates with the pump 27 and the ink cartridge 26 via the flow path 25.

Figure 3:
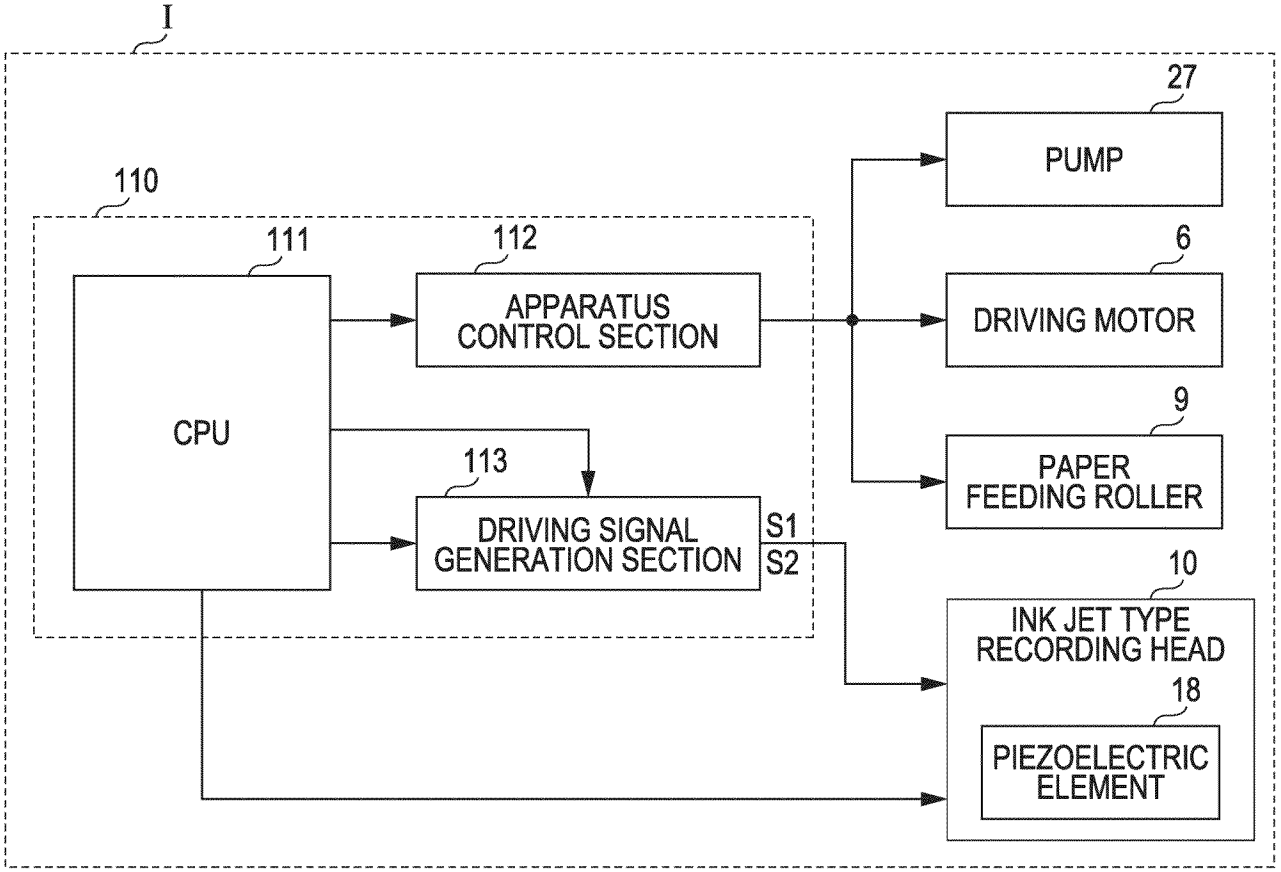
FIG. 3 is a block diagram illustrating a control system of the ink jet type recording apparatus in FIG. 1.

FIG. 3 is a block diagram illustrating a control system of the ink jet type recording apparatus I. As illustrated in the drawing, the ink jet type recording apparatus I has the control section 110 carrying out the control of the ink jet type recording apparatus I. The control section 110 includes a CPU 111, an apparatus control section 112, the driving signal generation section 113 which generates an ejection driving signal S1 and a micro-vibration driving signal S2 driving the piezoelectric element 18 that is a capacitive load.

When describing it in more detail, if the signal indicating the movement of the carriage 3 (see FIG. 1) is input to the apparatus control section 112 from the CPU 111, the apparatus control section 112 drives the driving motor 6 to move the carriage 3 along the carriage shaft 5, the signal indicating the transportation of the recording sheet S (see FIG. 1) is input to the apparatus control section 112 from the CPU 111, and the apparatus control section 112 drives a paper feeding roller 9 to transport the recording sheet S. At the same time, in the embodiment, the pump 27 is driven and the ink is circulated via the circulation path described above.

On the other hand, the driving signal generation section 113 determines whether the mode is an ejection mode or a micro-vibration mode with the data for generating the ejection driving signal S1 and the micro-vibration driving signal S2 from the CPU 111, and transmits one of the driving signals S1 and S2 to the ink jet type recording head 10. As a result, the driving signal generation section 113 selectively applies the driving signals S1 and S2 to each of piezoelectric elements 18 of the ink jet type recording head thereby ejecting the ink or generating the micro-vibration. Here, the ink jet type recording head 10 is configured in such a manner that a driver IC (not illustrated) supplies the head control signal from the CPU 111 thereby selectively driving each of piezoelectric elements 18.

Figure 4:
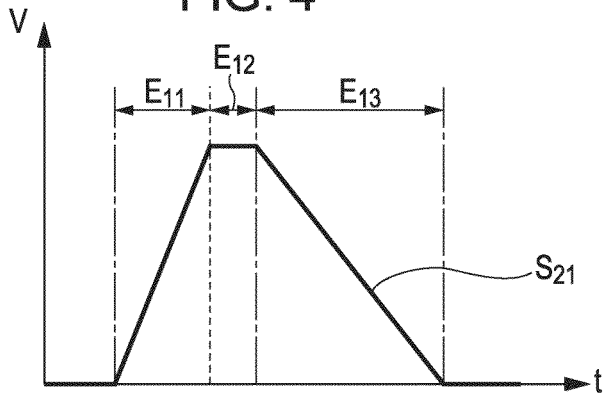
FIG. 4 is a waveform view illustrating a micro-vibration driving signal used in the embodiment of the invention.
Figure 5:
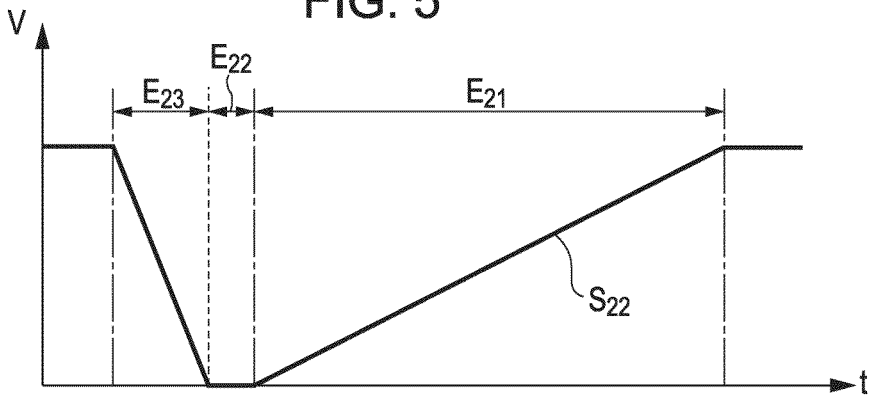
FIG. 5 is a waveform view illustrating one micro-vibration driving signal which is used in a simulation.
Figure 6:
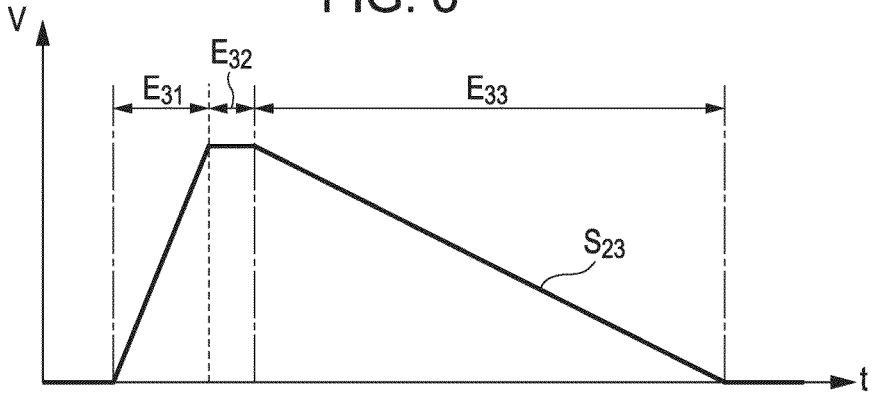
FIG. 6 is a waveform view illustrating another micro-vibration driving signal used in the simulation.
Figure 7A:
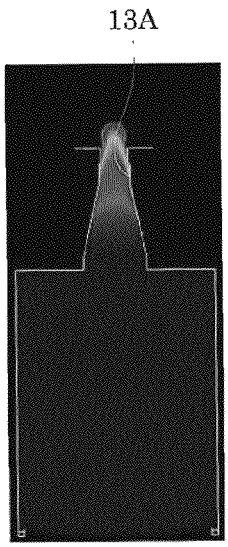
FIGS. 7A to 7C are photographs illustrating a simulation result using the driving signal in FIG. 5.
Figure 7B:
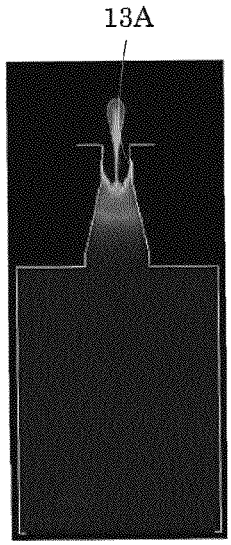
Figure 7C:
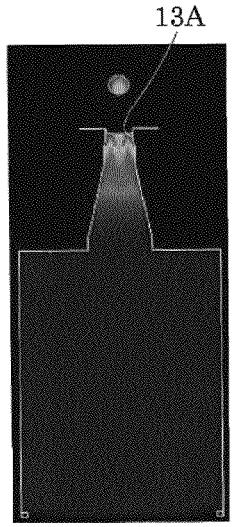
Figure 8A:
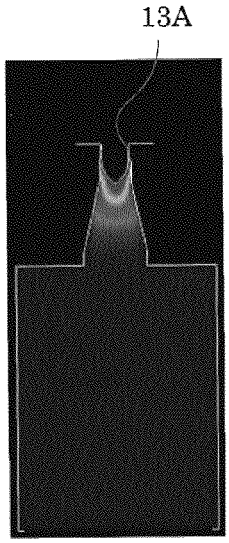
FIGS. 8A to 8C are photographs illustrating a simulation result using the driving signal in FIG. 6.
Figure 8B:
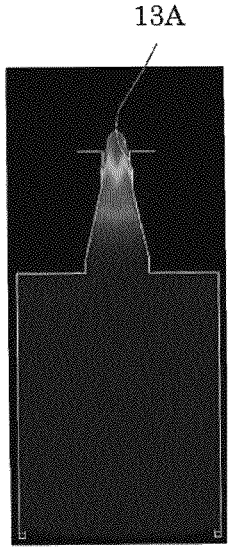
Figure 8C:
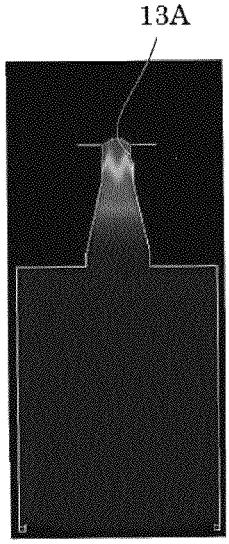
Figure 9:
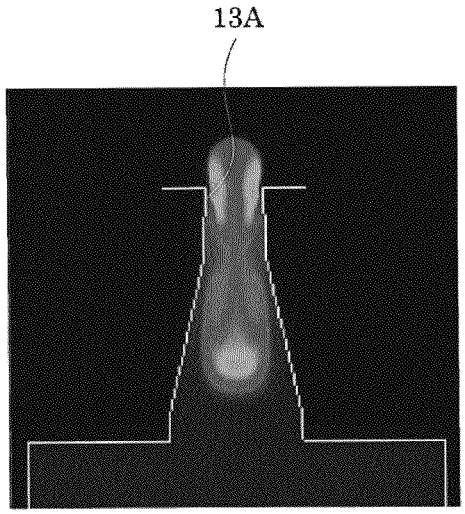
FIG. 9 is a simulation result in a high-frequency micro-vibration driving signal.
Figure 10:
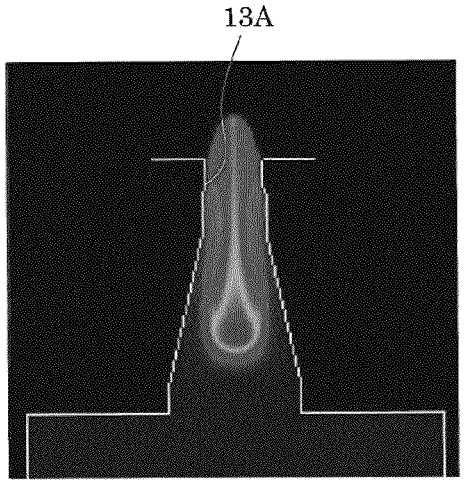
FIG. 10 is a simulation result in another driving signal for the high-frequency micro-vibration.
Figure 11A:
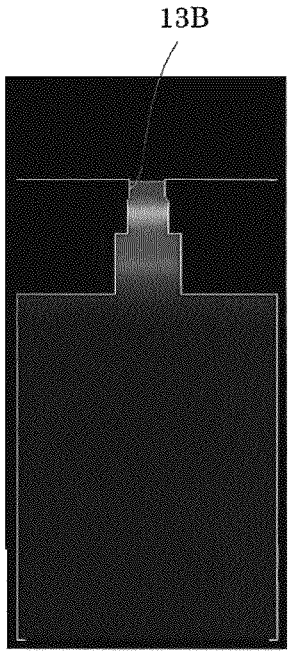
FIGS. 11A and 11B are photographs illustrating a simulation result when micro-vibrating using a two-step nozzle opening.
Figure 11B:
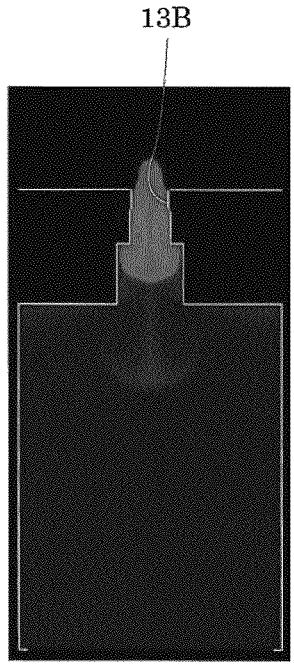
Figure 12A:
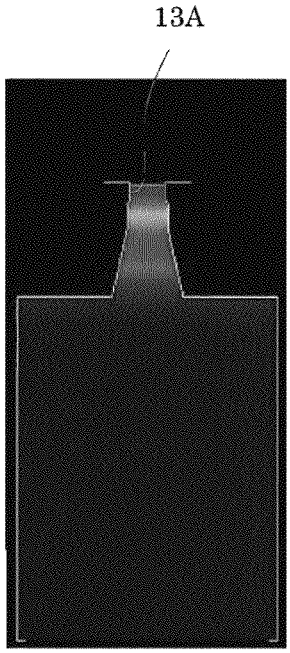
FIGS. 12A and 12B are photographs illustrating a simulation result when micro-vibrating using a tapered nozzle opening.
Figure 12B:
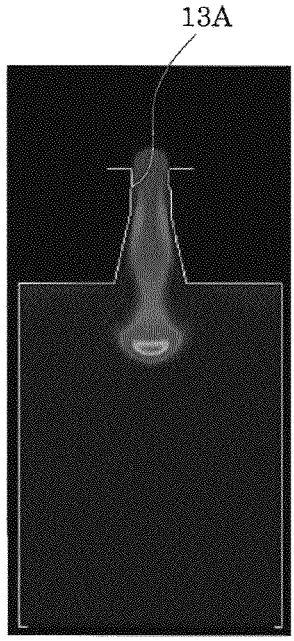

FIG. 4 is a waveform view illustrating the micro-vibration driving signal in the embodiment. As illustrated in the drawing, a micro-vibration driving signal $S_{21}$ in the embodiment has an expansion element $E_{11}$ in which the ink is drawn, a holding element $E_{12}$ in which a predetermined expansion state is held and a contraction element $E_{13}$ in which the ink is continuously pushed out. Here, inclination of the expansion element $E_{11}$ is formed to twice the inclination of the contraction element $E_{13}$. In other words, the micro-vibration driving signal is configured such that the draw is stronger than the push.

As a result, in the micro-vibration mode of the embodiment, since the operation in which the ink is drawn into the pressure generation chamber 12 in the expansion element $E_{11}$ is rapidly carried out more than in the operation in which the ink is pushed out in the contraction element $E_{13}$, the ink which has a high viscosity can be drawn into the pressure generation chamber 12 side opposite to the nozzle opening 13 by the micro-vibration. As a result, the ink which becomes the high viscosity can be favorably agitated in the vicinity of the nozzle opening 13 and the ejection characteristics of the ink can be favorably kept through the nozzle opening 13.

Furthermore, in the recording head 10 of the embodiment, since the ink charged in the pressure generation chamber 12 is circulated via the circulation flow path 28, the ink in the vicinity of the nozzle opening 13 is always replaced according to the circulation of the ink and the agitating effect of the ink by the micro-vibration is synergized and then the increase in the viscosity of the ink inside the pressure generation chamber 12 in the vicinity of the nozzle opening 13 can be effectively suppressed. Furthermore, in the recording head 10 of the embodiment, the diameter of the nozzle opening 13 is formed in a tapered shape which is gradually reduced towards the opening end thereof so that the agitating effect of the ink by the micro-vibration can also be optimized in terms of the shape of the nozzle opening 13.

Although the embodiment of the invention is described, the invention is of course not limited to the embodiment. For example, the relationship between the expansion element and the contraction element in the micro-vibration mode is within the scope of the technical idea of the invention if the inclination (a rate of change) of the expansion element with respect to the time axis is greater than that of the contraction element.

Furthermore, the ink jet type recording head according to the embodiments described above is the head having the longitudinal vibration type actuator in which the piezoelectric material and the electrode forming material are alternately laminated and then extended and contracted in the axial direction, however, the invention can be similarly applied to a head having a piezoelectric element that is a thick film type actuator as the pressure generation unit generating the pressure change in the pressure generation chamber and to a head having a piezoelectric element that is a thick film type actuator that is formed using a method in which a green sheet is attached. In addition, as the pressure generation unit, so-called a bubble type actuator in which a heating element is disposed inside the pressure generation chamber and the liquid droplets are ejected from the nozzle opening using the bubbles which are generated by heating from the heating element, or a so-called an electrostatic actuator in which the liquid droplets are ejected from the nozzle opening by generating static electricity between the vibration plate and the electrode and by deforming the vibration plate by an electrostatic force may be used.

Furthermore, the invention is widely intended for general liquid ejecting heads and, of course, can be applied to a liquid ejecting head ejecting a liquid other than ink. The liquid ejecting head in addition thereto, for example, includes various recording heads used for an image recording apparatus such as a printer, a color material ejecting head used for producing a color filter of a liquid crystal display or the like, an electrode material ejecting head used for forming the electrode of an organic EL display, FED (Field Emission Display) or the like, a bioorganic matter ejecting head used for producing a bio chip, or the like.

The entire disclosure of Japanese Patent Application No. 2012-026750, filed Feb. 9, 2012 is incorporated by reference herein.

What is claimed is:

1. A liquid ejecting apparatus comprising:

a liquid ejecting head having a pressure generation chamber in which a liquid is charged, a pressure generation unit which generates pressure change in the liquid inside the pressure generation chamber with supply of a driving signal, and a nozzle opening which ejects the liquid inside the pressure generation chamber according to the pressure change; and a control unit which has an expansion element expanding the pressure generation chamber and a contraction element contracting the pressure generation chamber, and supplies a micro-vibration driving signal to the pressure generation unit so as to generate the micro-vibration of the liquid to the inside of the pressure generation chamber without ejecting the liquid from the nozzle opening, wherein the micro-vibration driving signal is formed so that the inclination of the expansion element is greater than the inclination of the contraction element.

2. The liquid ejecting apparatus according to claim 1, wherein the relationship between the inclination of the expansion element and the inclination of the contraction element in the micro-vibration driving signal is (the inclination of the expansion element)≥2×(the inclination of the contraction element).

3. The liquid ejecting apparatus according to claim 1, wherein the liquid ejecting head has a circulation path in which the liquid charged in the pressure generation chamber is circulated.

4. The liquid ejecting apparatus according to claim 1, wherein the nozzle opening of the liquid ejecting head is formed as a tapered shape such that the diameter thereof is gradually decreased towards the opening thereof.

5. A method for controlling a liquid ejecting apparatus including a liquid ejecting head having a pressure generation chamber in which a liquid is charged, a pressure generation unit which generates pressure change in the liquid inside the pressure generation chamber with supply of a driving signal, and a nozzle opening which ejects the liquid inside the pressure generation chamber according to the pressure change, the method comprising:

controlling the liquid inside the pressure generation chamber to generate micro-vibrations with a micro-vibration driving signal without ejecting the liquid from the nozzle opening so that the inclination of an expansion element expanding the pressure generation chamber is greater than the inclination of a contraction element contracting the pressure generation chamber.

* * * * *